US005417322A

United States Patent [19]

Jeran et al.

[11] Patent Number: 5,417,322

[45] Date of Patent: May 23, 1995

[54] PACKAGE FOR AN ORGANIC PHOTOCONDUCTOR BELT THAT ENABLES NO-TOUCH INSERTION AND EXTRACTION OF BELTS

[75] Inventors: Paul L. Jeran, Boise; David L. Smith, Meridian; James J. Girard, Boise, all of Id.

[73] Assignee: Hewlett-Packard Company, Palo Alto, Calif.

[21] Appl. No.: 139,955

[22] Filed: Oct. 20, 1993

[51] Int. Cl.[6] ..... B65D 85/02; G03G 15/00

[52] U.S. Cl. ..... 206/303; 355/200; 355/212

[58] Field of Search ..... 355/210, 200, 211, 212, 355/260; 206/389, 393, 410, 303, 391, 53

[56] References Cited

U.S. PATENT DOCUMENTS

| | | | |
|---|---|---|---|
| 3,756,488 | 9/1973 | Van Megen et al. | 226/119 |
| 3,888,577 | 6/1975 | Meyer | 355/212 X |
| 3,984,241 | 10/1976 | Schremp et al. | 430/127 |
| 4,215,932 | 8/1980 | Castelli et al. | 355/212 |
| 4,739,371 | 4/1988 | Ray et al. | 355/212 X |
| 4,811,839 | 3/1989 | Cornell et al. | 206/303 |
| 5,119,133 | 6/1992 | Swain | 355/212 |
| 5,243,384 | 9/1993 | Everdyke et al. | 355/212 |

*Primary Examiner*—A. T. Grimley
*Assistant Examiner*—T. A. Dang

[57] ABSTRACT

An OPC belt is adapted for use in an EP printer which employs parallel drive rollers to move the OPC belt. A package for the OPC belt includes an outer package member that is shaped to be insertable over a used OPC belt on the drive rollers. The outer package member includes grippers which engage the used OPC belt once the outer package member is inserted over the used belt. The grippers maintain engagement with the used OPC belt as the outer package member is withdrawn from engagement with the drive rollers. The used OPC belt is thus removed from the drive rollers while still positioned within the outer package member. An inner package member is shaped to fit within the outer package member and holds a replacement OPC belt. The inner package member is insertable over the drive rollers to position the replacement OPC belt thereover. The inner package member is sized to be removable from engagement with the drive rollers when roller tension is increased on the replacement OPC belt.

7 Claims, 3 Drawing Sheets

FIG. 4.
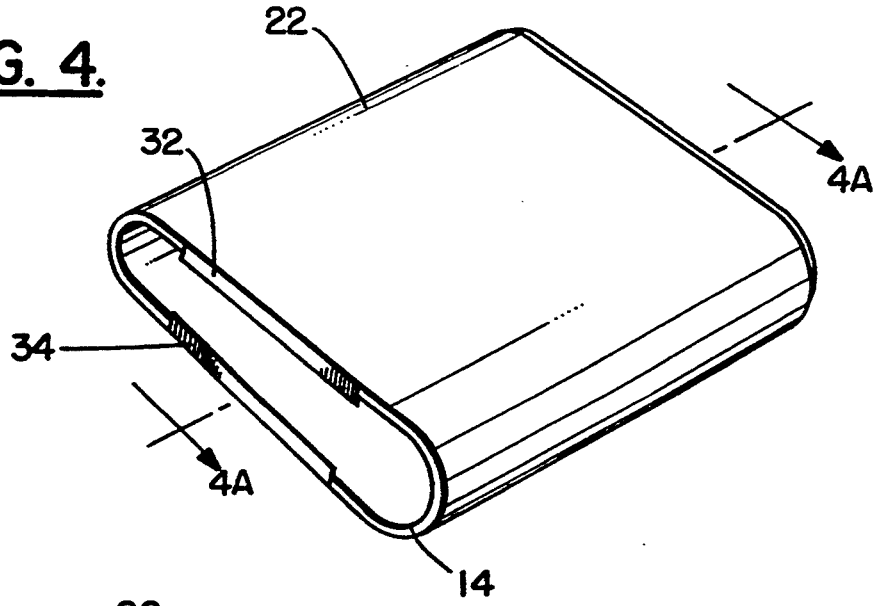
FIG. 4A.
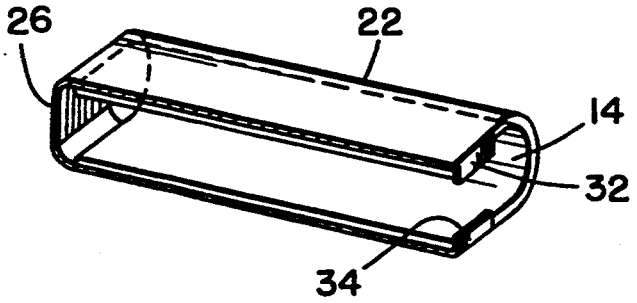
FIG. 5.
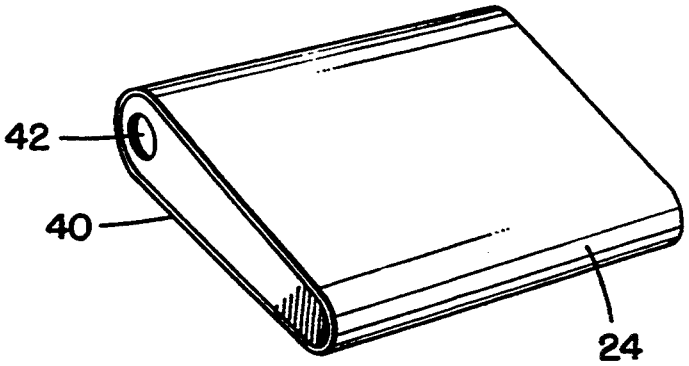
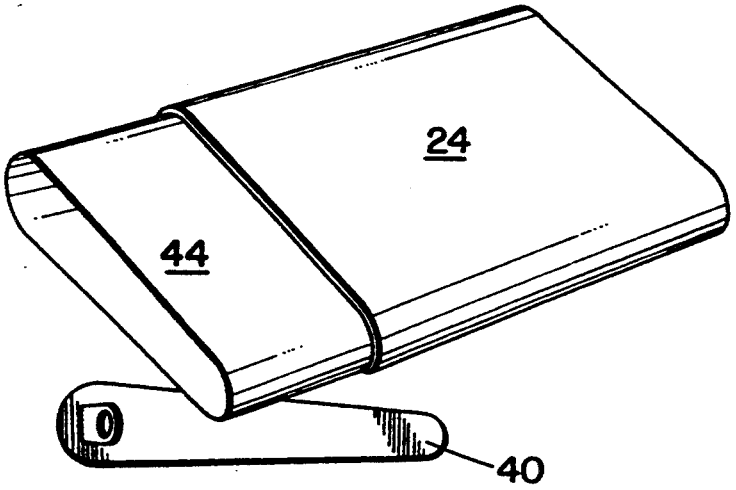
FIG. 6.

PACKAGE FOR AN ORGANIC PHOTOCONDUCTOR BELT THAT ENABLES NO-TOUCH INSERTION AND EXTRACTION OF BELTS

FIELD OF THE INVENTION

This invention relates to electrophotographic (EP) printers that employ organic photoconductor (OPC) belts and, more particularly, to a package for an OPC belt that enables a user to replace a used OPC belt with a new OPC belt without touching either the new or the replacement OPC belt.

BACKGROUND OF THE INVENTION

EP printers intended for the office environment employ either OPC belts or drums that employ an OPC coating. In either case, the OPC has a finite lifetime as the result of a variety of wear factors. For example, the chargeable layer of an OPC deteriorates over a period of time as a result of continued exposures to an imaging laser beam. More specifically, the electrical characteristics of the OPC layer change over time and thereby reduce the quality of the resulting image. Such OPC layers also generally include a release layer which tends to wear. This causes transfer of toner from the OPC to a paper sheet to be less efficient, leaving a residue on the OPC—which affects subsequent copies.

As the cost of EP printers has decreased, maintenance chores that were once carried out by a service representative are now relegated to the customer. For instance, many EP printers which employ an OPC coated drum, package the drum along with a toner supply and other drive mechanisms in a user-replaceable cartridge. While such packaging enables higher reliability operation of the EP printer, replacement cartridges are expensive and cause replacement of the drum prior to the end of its useful life.

Printers which employ OPC belts enable the user to access the belt for replacement purposes. In certain such printers, the spent belt is contained in a cartridge and the complete cartridge is replaceable. In other printers, the spent belt is required to be handled in the replacement process which causes the user to get toner on himself/herself during the replacement process. Furthermore, handling of the replacement belt by the user sometimes occurs and impairs its function.

Accordingly, it is an object of this invention to provide an improved package for a replacement OPC belt that enables a simple and environmentally sound method for replacing the OPC belt in a printer.

It is another object of this invention to provide an improved package for a replacement OPC belt which enables a user to remove a spent OPC belt without handling it.

It is yet another object of this invention to provide an improved package for a replacement OPC belt which is inexpensive and enables a belt to be replaced without requiring replacement of other mechanisms in the printer.

SUMMARY OF THE INVENTION

An OPC belt is adapted for use in an EP printer which employs parallel drive rollers to move the OPC belt. A package for the OPC belt includes an outer package member that is shaped to be insertable over a used OPC belt on the drive rollers. The outer package member includes grippers which engage the used OPC belt once the outer package member is inserted over the used belt. The grippers maintain engagement with the used OPC belt as the outer package member is withdrawn from engagement with the drive rollers. The used OPC belt is thus removed from the drive rollers while still positioned within the outer package member. An inner package member is shaped to fit within the outer package member and holds a replacement OPC belt. The inner package is insertable over the drive rollers to position the replacement OPC belt thereover. The inner package member is sized to be removable from engagement with the drive rollers when roller tension is increased on the replacement OPC belt.

DESCRIPTION OF THE DRAWINGS

FIG. 4 illustrates the outer package member when a used OPC belt has been removed and is positioned therein.

FIG. 4a is a sectional view of the outer package member of FIG. 4 taken along line A—A.

FIG. 5 is a perspective view of the inner package member before it is opened.

FIG. 6 is a perspective view of the inner package member of FIG. 5 after it has been opened and a replacement OPC belt partially removed therefrom.

DETAILED DESCRIPTION OF THE INVENTION

Figure 1:
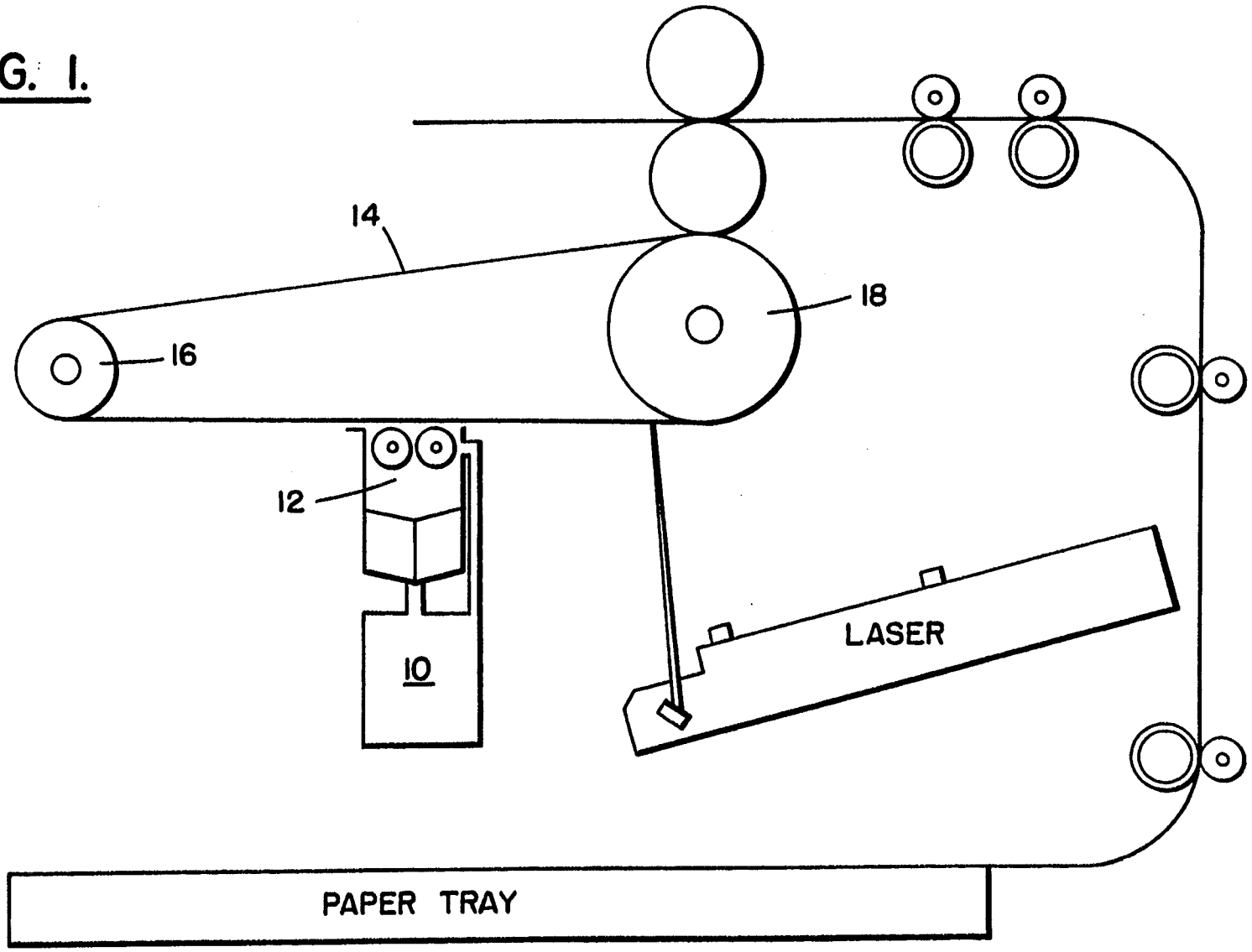
FIG. 1 is a side schematic view of an EP printer mechanism that employs an OPC belt.

Referring now to FIG. 1, a schematic side view is shown of an EP printer after a side access door has been opened (not shown). The EP printer includes a toner reservoir 10 which feeds its toner to developer module 12. An OPC belt 14 is tensioned over drive rollers 16 and 18. The distance between drive rollers 16 and 18 may be changed by user actuation of a lever mechanism (not shown). Operation of the lever mechanism causes drive rollers 16 and 18 to be drawn more closely together, thereby releasing the tension on OPC belt 14. The de-tensioning action enables removal of OPC belt 14 from engagement with drive roller 16 and 18.

Figure 2:
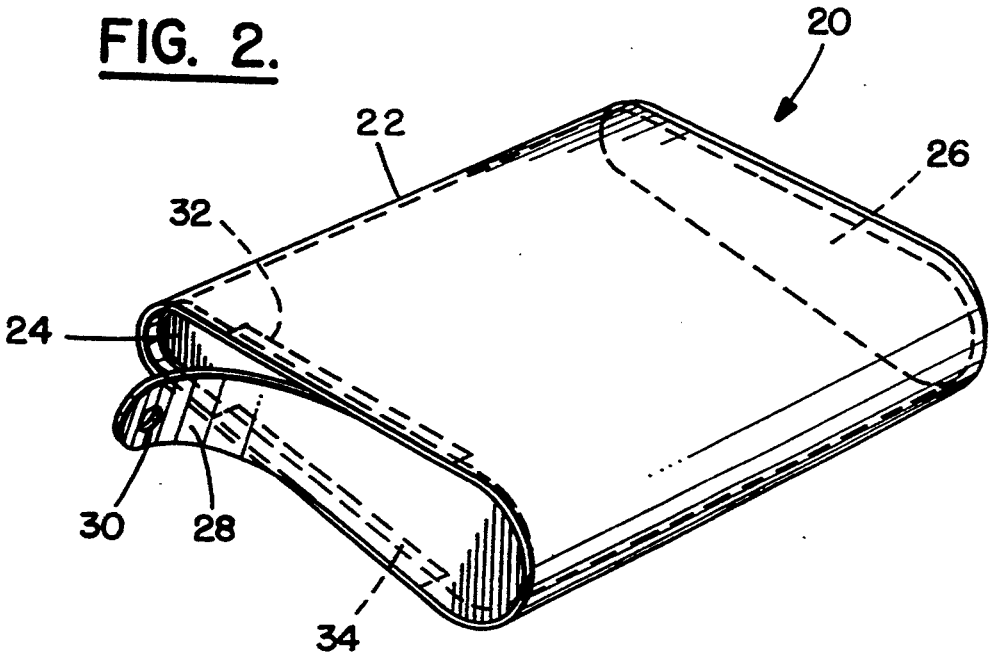
FIG. 2 is a perspective view of an OPC package that incorporates the invention hereof.

Referring to FIG. 2, a package 20 is shown that holds a replacement OPC belt. Package 20 comprises an outer package member 22 that is shaped to be insertable over drive rollers 16 and 18 (FIG. 1). Within outer package member 22 is a sealed inner package member which contains a replacement OPC belt. One end 26 of outer package member 22 is closed and the other end is sealed by a cover 28 that is removable through user actuation of a pull tab 30. A pair of flaps 32 and 34 are resiliently bent inwardly from opposed sides of outer package member 22 and are held in their bent positions by inner package member 24.

Figure 3:
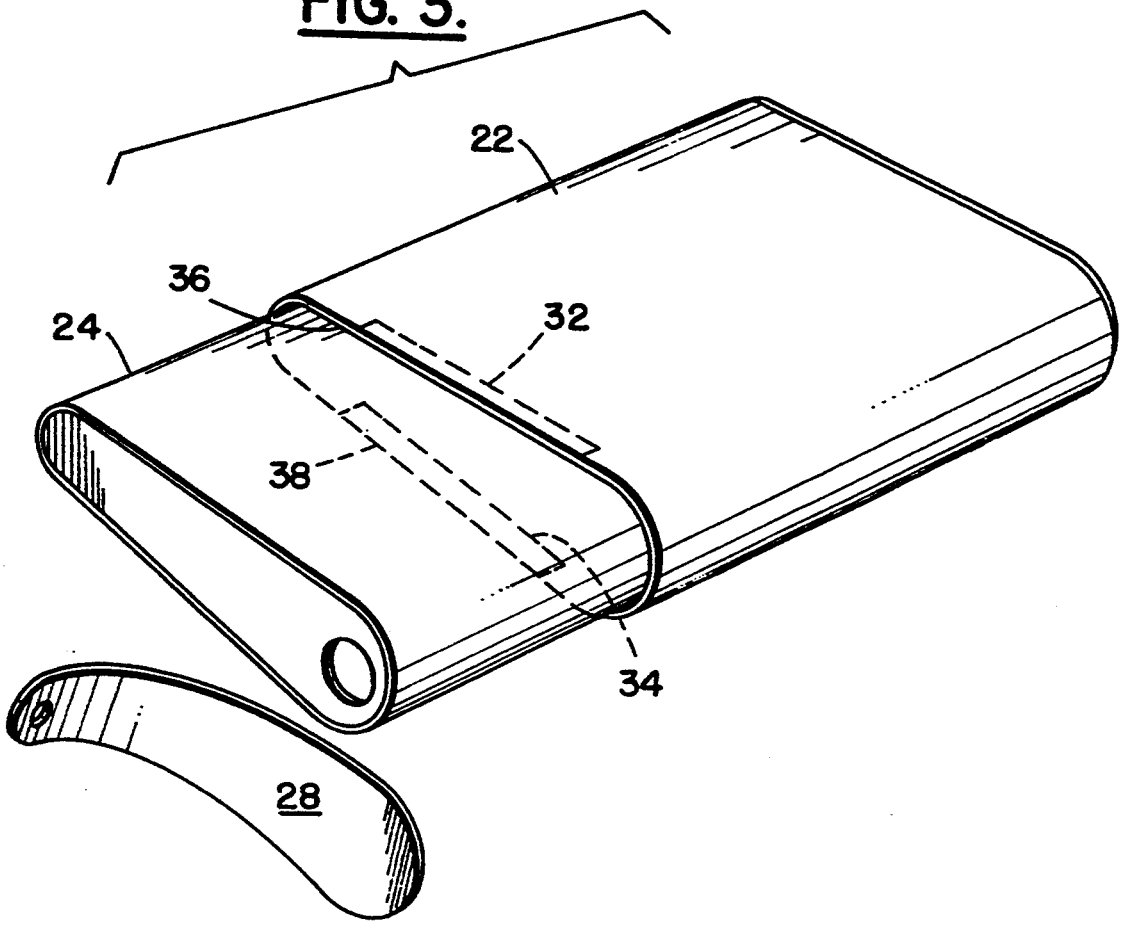
FIG. 3 is a perspective view of the package of FIG. 2 showing an inner package member being removed from an outer package member.

In FIG. 3, inner package member 24 is shown partially removed from outer package member 22. Once inner package member 24 is completely removed from outer package member 22, outer package member 22 is ready to be used to extract a used OPC belt 14. To perform this function, outer package member 22 is inserted over drive rollers 16 and 18 and is pushed inwardly into the EP printer until flaps 32 and 34 clear the innermost edges of OPC belt 14. At such time, flaps 32 and 34 rotate from their bent position to a downwardly-extended position under the influence of the resilient actions of bend areas 36 and 38. Flaps 32 and 34 thus engage both the upper and lower edges of OPC belt 14 and act as grippers to enable removal of OPC belt 14.

Removal is enabled when the lever mechanism that controls the positioning of drive rollers 16 and 18 is operated to de-tension OPC belt 14. The user then removes outer package member 22, causing flaps 32 and 34 to grab both the upper and lower innermost edges of OPC belt 14. This causes OPC belt 14 to be removed from drive rollers 16 and 18, as outer package member is removed therefrom.

In FIG. 4, outer package member 22 is shown just after removal of a used OPC belt 14. Flap members 32 and 34 remain engaged with the edges of OPC belt 14. FIG. 4A shows a sectional view of FIG. 4 taken along line A—A and illustrates the position of used OPC belt 14 within outer package member 22.

As shown in FIG. 5, inner package member 24 is sealed by a rip top cover 40. User actuation of pull tab 42 enables removal of rip-top cover 40, thereby exposing a replacement OPC belt 44. In FIG. 60PC belt 44 is shown partially removed.

Replacement OPC belt 44 is positioned over drive rollers 16 and 18 by inserting inner package member 24 thereover (while rollers 16 and 18 are in their de-tensioned position). Once inner package member 24 is fully inserted, the lever mechanism is operated to move drive rollers 16 and 18 to tension belt 44. The internal dimensions of inner package member 24 are such that clearance still remains between OPC belt 44 and the inner surfaces of the package when rollers 16 and 18 are tensioned. This allows inner package member 24 to be removed, leaving 0PC belt 44 in place.

It can thus be seen that outer package member 22 enables removal of a used 0PC belt 14 without requiring the user to, in any way, touch the belt. Outer package member 22 with the used OPC belt may then be discarded. Once inner package member 44 is removed, it too may be discarded. Both inner and outer package members 22, 24 are free-standing and may be molded plastic or a combination of plastic end portions and cardboard wall members.

It should be understood that the foregoing description is only illustrative of the invention. Various alternatives and modifications can be devised by those skilled in the art without departing from the invention. For instance, while the invention has been described in the context of an EP printer, it is equally applicable to any instrumentality that employs a replaceable OPC belt. Accordingly, the present invention is intended to embrace all such alternatives, modifications and variances which fall within the scope of the appended claims.

What is claimed is:

1. A package for an organic photoconductor (OPC) belt, said OPC belt for use in a printer having opposed, parallel, drive rollers which are user operable to tension and de-tension an OPC belt positioned thereon, said package comprising:

an outer package member shaped to fit over and encompass an OPC belt positioned on said drive rollers and including belt grip means for engaging said OPC belt so that user withdrawal of said outer package member from said drive rollers, when de-tensioned, causes said OPC belt to also be withdrawn from said drive rollers; and an inner package member shaped to fit within said outer package member, for holding a replacement OPC belt, and further shaped to fit over said drive rollers so as to position said replacement OPC belt on said drive rollers when said drive rollers are de-tensioned.

2. The package as recited in claim 1 wherein said belt grip means engages said OPC belt only when said outer package member fully encompasses said OPC belt on said drive rollers.

3. The package as recited in claim 2 wherein said OPC belt, when engaged with said drive rollers, exhibits innermost and outermost edges, said outermost edges closest to an aperture through which said outer package member is insertable to encompass said drive rollers, said belt grip means engaging said innermost edges.

4. The package as recited in claim 3 wherein said outer package member includes an open end which mates with and is movable over said OPC belt and drive rollers, said belt grip means comprising opposed flaps that are connected at said open end to walls of said outer package member at attachment regions, each attachment region resiliently biasing a said flap away from an adjacent wall.

5. The package as recited in claim 1 wherein said inner package member and a contained replacement OPC belt are arranged to mate with said drive rollers when said drive rollers are de-tensioned, said inner package member removable from engagement with said drive rollers when said drive rollers are tensioned to grip said replacement OPC belt.

6. The package as recited in claim 1 wherein both said inner package member and outer package member exhibit flattened cylindrical form factors that are self-supporting and free-standing.

7. The package as recited in claim 6, wherein both said inner package member and outer package member include detachable covers, which when detached expose openings that enable either package to internally receive said disc rollers and an OPC belt positioned thereon.

* * * * *